United States Patent [19]

O'Connell et al.

[11] 4,063,888

[45] Dec. 20, 1977

[54] PROCESS FOR PREPARING SPACE-DYED YARN

[75] Inventors: Richard A. O'Connell, El Cerrito; Robert E. Foster, Concord, both of Calif.

[73] Assignee: The United States of America as represented by the Secretary of Agriculture, Washington, D.C.

[21] Appl. No.: 744,582

[22] Filed: Nov. 23, 1976

[51] Int. Cl.[2] ..... D06B 5/18

[52] U.S. Cl. ..... 8/149; 8/155.1

[58] Field of Search ..... 8/148, 149, 155.1, 155.2, 8/154; 68/189, 198, 201, 206, 211

[56] References Cited

U.S. PATENT DOCUMENTS

| | | | |
|---|---|---|---|
| 1,613,707 | 1/1927 | Johnston | 68/201 X |
| 3,975,930 | 8/1976 | Lunsford et al. | 68/189 |

FOREIGN PATENT DOCUMENTS

| | | | |
|---|---|---|---|
| 7,318 | 5/1927 | Australia | 8/148 |
| 487,934 | 6/1938 | United Kingdom | 8/148 |

*Primary Examiner*—Philip R. Coe

*Attorney, Agent, or Firm*—M. Howard Silverstein; David G. McConnell; Theodore J. Leitereg

[57] ABSTRACT

Yarn is space-dyed by a process wherein the yarn is wound around a receptacle, e.g., a perforated package dyeing tube. A dyebath is allowed to flow through the yarn. The flow of dye is partially restricted or channeled in such a manner that the yarn becomes intermittently dyed.

2 Claims, No Drawings

PROCESS FOR PREPARING SPACE-DYED YARN

BACKGROUND OF THE INVENTION

1. Field of the Invention

This invention relates to and has among its objects the provision of novel procedures for space-dyeing yarn. Further objects of the invention will be evident from the following decription wherein part and percentages are by weight unless otherwise specified.

In today's fashion market yarn of novel coloration is in demand for production of articles such as clothing, carpets,upholstery, and the like. One way of producing novel coloration of yarns is space-dyeing—the intermittent coloration of yarn in various shades. When the yarn is procesed into frabric, unusual and attractive design effects result, the most common of which are random coloration and repeat (Barre) coloration.

2. Description of the Prior Art

There are a number of techniques for obtaining a space-dyed yarn. For example, yarn in hank form may be knotted or tied with rubber sleeves or some other constricting device. Following dyeing the constricted portions remain undyed. Another technique involves knitting the yarn into fabric, printing the fabric with a variety of colors, and deknitting the fabric into yarn which can then be formed, e.g., knitted, woven, etc., into articles. Yarn may also be spooled onto beams and sheets of yarn removed from the beam and printed. Then, the printed yarn may be respooled onto another beam and used in manufacture.

Space-dyed yarn can also be prepared by a process wherein the yarn is loaded onto package dyeing equipment commonly used in the dyeing industry and dye injected into the package through hollow needles, each containing a different dye. Alternatively, the package loaded with yarn may be dipped partially into a dye solution and held to allow the dye to diffuse through the package.

All of the above methods for producing a space-dyed effect possess disadvantages. Generally, the above methods require additional handling or processing operations over normal dyeing. The added operations are time-consuming and costly.

Summary of the Invention

The invention described herein provides means for obviating the above problems. The process of the invention can be practiced using conventional dyeing equipment and operations to obtain a space-dyed product. In the instant process yarn is wound on a receptacle. Then, a dye solution is pumped through the yarn. The flow of dye through the yarn is partially restricted or channeled in a manner which will yield an intermittently dyed yarn. Dyeing conditions which yield a rapid dye strike are chosen.

One advantage of the invention is that it may be practiced, with only slight modification, using conventional package dyeing equipment to be found in any textile-treating plant. Thus, purchase of new equipment, etc., is avoided.

Another advantage of the invention is that it is economical, that is, savings of both time and money are realized. This advantage results because conventional package dyeing procedures are followed and additional operations are unnecessary. The yarn may be space-dyed in a single, simple step which often involves less time than normal dyeing.

Another advantage of the invention is that a number of space-dyed effects can be obtained. For example, yarn dyed in accordance with the invention shows a repeat pattern along the yarn which results in a Barre (repeat) effect when the yarn is knitted from single ends. A random effect is produced if the yarn of the invention is plied or if multiple ends are knitted together. Two-tone effects are obtained by over-dyeing yarn previously space-dyed according to the process of the invention.

Another advantage of the invention is that it has extensive utility and can be applied to yarn which consists entirely of protein fibers (e.g., wool, mohair, silk, camel or other animal hair; regenerated protein fibers such as those prepared from casein, soybeans, peanut protein, zein, gluten, egg albumin, collagen, or keratins such as feathers, animal hoof or horn, etc.). The invention can also be applied to yarn composed of synthetic or non-proteinaceous natural fibers, such as cotton, linen, hemp, jute, ramie, sisal, cellulose acetate, cellulose acetate-butyrate, saponified acetate rayons, viscose rayons, cuprammonium rayons, ethyl cellulose, polyurethane, polyacrylonitrile, polyesters such as polyethylene terephthalate, polyamides such as polyhexamethylene adipamide, polycaprolactam, polyolefins such as polypropylene and polyvinylchloride, and the like. It is also within the purview pof the invention to space-dye yarns which are mixtures of proteinaceous and other fibers, such as synthetic and non-proteinaceous fibers, or yarns which are mixtures of synthetic and non-proteinaceous fibers.

DESCRIPTION OF THE PREFERRED EMBODIMENTS

In space-dyeing in accordance with the invention one proceeds in part as in conventional dyeing operations. Yarn is wound on a receptacle which may take the form of a conventional package used in normal package dyeing. The conventional package is a cylindrical tube perforated to allow dye to flow through the yarn. Other receptacles which can be used in the process of the invention will be evident to those skilled in the art from the description that follows. Generally, the amount of yarn which is placed upon the receptacle is determined according to normal dyeing principles. However, some adjustments may be necessary depending on the nature and extent of the space-dyeing which is desired.

After the yarn has been placed on the receptacle, it may be treated, if necessary, to remove spinning oils and the like. Generally, this is accomplished by scouring the yarn with a detergent.

Then, a dyebath is prepared and allowed to flow through the yarn from the outside inward through the yarn and from the inside outward through the yarn. The flow of dye through-in and through-out the yarn may be facilitated by pumping and is partially restricted or channeled in such a manner as to produce an intermittently dyed effect in the dyed yarn.

Partial restriction of the dye-flow can be achieved in a variety of ways, examples of which follow: If the yarn is wound around a conventional perforated package, some of the holes in the package can be blocked to force the dye liquor through specific areas of the yarn when the liquor is being circulated. Any suitable material, such as film, foil, etc., can be used as the blocking material as long as it is impervious to the dye. It is necessary in this particular embodiment of the invention to block an area on the outside of the yarn corresponding to the area blocked inside the wound yarn. This step is required to limit flow of the dye throughout the entire package of yarn which would hinder intermittent dyeing. Either longitudinal or lateral sections of the package can be blocked depending on the nature of intermittent dyeing desired.

Another means of partially restricting the flow of dye through-in and through-out the wound yarn is to employ specially-prepared packages or tubes which have holes or perforations only in certain sections. It is important to remember, however, that an area corresponding to the permanently blocked area in the package must also be blocked on the outside of the wound yarn in this particular embodiment of the invention.

Partial restriction of the dye-flow through the yarn can be achieved also by applying a clamp to the outside surface of the yarn. The clamp can be tightened to a level sufficient to achieve the amount of intermittent dyeing desired. A variation of this approach involves using film or foil on the inside of the wound yarn around the receptacle and a clamp on the outside of the yarn.

Alternative methods of carrying out the process of the invention will be suggested to those skilled in the art in view of the examples outlined above.

Generally, a rapid dye strike is preferred. Thus, conditions of dyeing such as the use of retardants or other adjuvants, the pH of the dyebath, and the temperature are adjusted accordingly. Usually, the temperature of the dyebath is about from 50° to 100° C. Retarding adjuvants are avoided, thereby enhancing the rapidity of the dye strike. A more rapid strike is also dependent on pH, which in turn varies with the type of yarn and the type of dye used. A preferred pH range for space-dyeing of wool is 2–5. It should be noted that a space-dyed effect can be attained under normal dyeing conditions; however, a rapid strike is preferred. It should be noted further that a rapid strike is avoided in normal dyeing because it results in non-level dyeing.

It is preferable also that the contact time between the dyebath and the yarn be shorter than in normal dyeing. Contact between the dyebath and the yarn should be maintained for about from 5 to 60 minutes.

Other operations, equipment, and conditions are as employed in conventional package dyeing. the dye used is obviously selected according to color desired and ability to dye the yarn under treatment. It should be pointed out that the conditions of dyeing mentioned above vary with the type of dyestuff used and the type of yarn being dyed.

After completion of the dyeing, the dyebath is separated from the package of yarn, which is then rinsed to remove residual dye, treated to remove excess water, and dried. The intermittently-dyed yarn is ready for use in preparing articles with a space-dyed design.

In a less-preferred embodiment of the invention the dye can be circulated through the yarn in only one direction, either from the inside out or from the outside in. Effective intermittent dyeing is obtained but not as effective as with a bidirectional flow as described above.

EXAMPLES

The invention is further demonstrated by the following illustrative examples.

EXAMPLE 1

A conventional perforated package-dyeing tube was wrapped with aluminum foil laterally to block the middle third of the perforations. Cotton yarn (2/36's cc, 454 g.) was wound on the tube. The wound package was wrapped with an inert plastic film on the surface of the yarn in an area corresponding to the blocked area on the inside of the package. A stainless steel band was clamped tightly around the film-covered section.

The so-prepared package was placed in a one-pound package dyeing machine and scoured for 45 minutes with a soda ash and detergent solution at 85° C. The scouring bath was removed, the yarn was rinsed, and a fresh water bath containing 5% sodium sulfate and 0.5% of IGEPAL CO710 (a nonionic wetting agent manufactured by General Dyestuff Corporation) was added. The bath was heated to and maintained at 84° C. and 1 g. of CALCODUR RESIN FAST BLUE 3G (American Cyanamid Co.) was added. The dyebath was pumped through the package from the inside to the outside. After 3 minutes the direction of flow was changed so that the dyebath was now pumped through the package from the outside to the inside. At this time also another 1-g. portion of dye was added. The bath was removed after 3 minutes and the hot package was allowed to stand for 15 minutes. The package was rinsed with water and removed from the machine; the yarn was dried and wound on a cone. A thin, undyed section encircled the package from beginning to end.

The intermittently dyed yarn was knitted into fabric as follows: A single end was knitted using a flat-bed knitter to produce a fabric exhibiting a repeat (Barre) undyed pattern. Multiple ends were knitted on a circular knitter and yielded a fabric with a randomly dyed appearance.

EXAMPLE 2

A. Eight 454-g. packages of wool yarn (1/30's wc) were packaged with areas of flow restricted as in Example 1.

B. Another eight 454-g. packages of this wool were wound on a package tube prepared as follows: the package tube was wrapped with aluminum foil to block 80% of the perforations, leaving open a longitudinal strip comprising the remaining 20% of the holes. The wound package was partially wrapped with aluminum foil, leaving open on the surface of the yarn an area corresponding to the open area on the inside of the package.

C. An additional eight 454-g. packages were prepared from the same wool yarn with no blockages or restrictions at all.

The 24 packages were put in a 24-pound package dyer. The packages of yarn were scoured with a detergent solution containing 0.05% IGEPAL CO710 at 55° C. for 4 min. and rinsed twice with water. A fresh bath of water containing acetic acid (pH 3.5) was added and the temperature of the bath was raised to and maintained at 88° C. A 8.5-g. portion of Cibacrolan Green VM (CIBA Chemical and Dye Co.) was added and the dyebath was pumped through the packages from the outside to the inside for 10 min. Then, the direction of flow of the dyebath was changed to inside-out flow and an 8.5-g. portion of dye was again added. After 17 min. the bath was removed and the packages of yarn were rinsed twice with water. The packages were removed from the machine and the yarn was dried and wound on cones. The yarn dyed in A and B above exhibited intermittently dyed effects and were knitted into fabrics as in Example 1. The knitted fabrics possessed excellent space-dyed effects.

The yarns in Part C (unblocked packages) were not space-dyed.

EXAMPLE 3

A conventional perforated package-dyeing tube was wrapped with aluminum foil to block 80% of the perforations; a longitudinal strip comprising the remaining 20% of the holes was left open. Wool yarn (2/20's wc 454-g.) was wound on the tube. The wound package was partially wrapped with aluminum foil, leaving open on the surface of the yarn an area corresponding to the open area on the inside of the package.

The package containing the yarn was placed in a one-pound package dyeing machine and scoured with a nonionic detergent to remove spinning oils as in Example 2. The scouring bath was removed and replaced with a fresh water bath and brought to pH 4.3 by addition of acetic acid. The bath was heated to 77° C. and pumped through the wound yarn from the inside to the outside. One-half gram of Cibacrolan Green VM in 200 ml. of water was added to the circulating bath. After 5 min. the dye was exhausted on the yarn. The dyebath was removed and the package of yarn was rinsed with water in the usual manner. The package was removed from the machine and dried, and the yarn was wound onto a cone. An undyed section displaced 180° from the opening was apparent. The so-prepared yarn was knitted into fabrics as described in Example 1; the fabrics exhibited very good spacedyed effects.

Having thus described our invention, we claim:

1. A method of space-dyeing yarn, which comprises -
   a. winding the yarn on a perforated package dyeing tube, said tube having some of its perforations blocked prior to winding the yarn thereon,
   b. blocking an area on the outer surface of the so-wound yarn corresponding to the area blocked on the perforated tube, and
   c. providing a flow of dye through the so-wound yarn from the outside of the yarn to the inside and from the inside of the perforated tube to the outside of the yarn, the conditions of dyeing being adjusted to achieve a rapid dye strike, the contact time between the dyebath and the yarn being shorter than in normal dyeing.

2. The process of claim 1 wherein the dyeing is conducted in a standard package dyeing apparatus.

* * * * *